United States Patent [19]

Midavaine

[11] Patent Number: 4,999,502

[45] Date of Patent: Mar. 12, 1991

[54] DEVICE FOR GENERATING AN INFRARED IMAGE

[75] Inventor: Thierry Midavaine, Paris, France

[73] Assignee: SAT (Societe Anonyme de Telecommunications), Cedex, France

[21] Appl. No.: 414,489

[22] Filed: Sep. 28, 1989

[30] Foreign Application Priority Data

Sep. 30, 1988 [FR] France ..... 88 12790

[51] Int. Cl.[5] ..... G01J 1/00

[52] U.S. Cl. ..... 250/495.1; 250/504 R; 250/493.1

[58] Field of Search ..... 250/495.1, 333, 332, 250/330, 504 R, 493.1; 313/380, 388, 364

[56] References Cited

U.S. PATENT DOCUMENTS

| | | | |
|---|---|---|---|
| 3,831,029 | 8/1974 | Jones et al. | 250/333 |
| 4,053,806 | 10/1977 | Turnbull et al. | 250/333 |
| 4,058,734 | 11/1977 | Vroombout | 250/495.1 |
| 4,178,514 | 12/1979 | Bly | 250/495.1 |
| 4,317,063 | 2/1982 | Pedder et al. | 250/333 |
| 4,542,299 | 9/1985 | Scholz | 250/504 R |
| 4,572,958 | 2/1986 | Durand et al. | 250/495.1 |
| 4,675,525 | 6/1987 | Amingual et al. | 250/332 |
| 4,687,967 | 8/1987 | Rusche et al. | 313/477 R |

*Primary Examiner*—Jack I. Berman
*Assistant Examiner*—Kiet T. Nguyen
*Attorney, Agent, or Firm*—Lowe, Price, LeBlanc, Becker & Shur

[57] ABSTRACT

A device is divulged for generating an infrared image, in which an electron beam having a section substantially equal to the area of a pixel formed from a material having high emissive power in the infrared, directly bombards this material. The energy of the beam is transformed into heat then into infrared radiation, in the material. Each pixel is supported by a slab of a material transparent to the infrared, which is heat insulating and deposited on a screen transparent to the infrared and heat conducting.

6 Claims, 1 Drawing Sheet

DEVICE FOR GENERATING AN INFRARED IMAGE

BACKGROUND OF THE INVENTION

1. Field of the Invention

The present invention relates to a device for generating an infrared image, comprising a screen transparent in the infrared and supporting a plurality of pixels made from a material having high emissive power in the infrared and means for selectively heating the material of each of said pixels.

Such a device is used for testing infrared imagery devices, such for example as missile homing devices, by reproducing in the laboratory infrared images as close as possible to those which will be met with in reality.

2. Description of the Prior Art

A device of the above type is already known, described in U.S. Pat. No. 4,572,958 to Durand et al. In this device, the selective heating means comprise an electron beam or laser beam, of small diameter with respect to the dimensions of a pixel, which bombards a portion, in the form of a median strip, of a thin layer of good heat conducting material which extends over an area equal to that of a pixel. The purpose of this layer is both to convert the energy of the beam into heat and to diffuse the heat occurring in the strip shaped portion towards the whole of the surface of the layer and parallel to this layer. Two slabs of heat insulating material, disposed in contact with the preceding layer and on each side of the electron beam path before its impact, slowly diffuse the heat of the layer, perpendicularly this time to this layer and in a direction opposite the displacement of the electrons, towards two layers made from a material having high emissive power in the infrared, in this case two black body layers, whose purpose is to convert the heat into infrared radiation, these two black body layers forming the pixel properly speaking. Naturally, the preceding slabs, as well as the layer for converting the energy of the beam into heat, disposed between the two black body layers and the screen, are transparent to the infrared.

In the case where the beam bringing the energy to the pixels is an electron beam, the device is in the form of a cathode ray tube making it possible to obtain animated infrared images from a video signal of known type.

The structure of the screen of such a device is relatively complex and so of a high cost price. Furthermore the performance of such a device is limited because of the use of a low power beam, this being imposed by its necessarily restricted diameter.

SUMMARY OF THE INVENTION

The objective of the present invention is to overcome these drawbacks.

For this, it provides a device of the above type, characterized by the fact that said heating means comprise an electron beam directly bombarding said high emissive power material and having a section at least substantially equal to the area of a pixel.

In the device of the invention, the high emissive power material causes, in addition to conversion of heat into infrared radiation, which it does already in the known device, conversion of the energy of the beam into heat, which was provided in the known device by the good heat conducting layer. This result is made possible, in particular, because the section of the beam is at least equal to the area of the pixel, which means that the conversion of the energy of the beam into heat takes place over the whole surface of the pixel, instead of occurring over a limited portion of this surface. Consequently, it is no longer necessary to diffuse the heat parallel to the surface of the screen so that it occupies the whole surface of the pixel. It is now possible for the black body to fulfil the function of converting the energy of the beam into heat, which consequently has an extremely simple structure. In the device of the invention, the diameter of the beam is appreciably greater than in the known device, because of the increase of the current generating this beam. Thus, the increase of the power transported by the beam, for heating the black body to higher temperatures than those of the known device, raises no particular problems. Thus, the device of the invention makes it possible to produce infrared images whose maximum intensity is appreciably greater than that of the known device.

Advantageously, a reticulated layer of material transparent in the infrared and heat insulating is disposed between said screen and said pixels.

In this case, an image remanence occurs, which limits flickering thereof, and encroachment of a pixel on its neighbors is avoided. Such remanence however no longer forms a requirement for testing modern infrared systems using bars or mosaics; only the synchronization of the lines or of the images must be provided between the generator and the observer device.

Again advantageously, said screen is a heat conductor and is provided with means for cooling said screen, so as to dissipate the heat to a temperature close to the ambient temperature.

In this case, the image obtained remains very contrasty and, if it is animated, streaking thereof is reduced.

Still advantageously, a layer, which is anti-reflective in the wavelength range of use of the infrared image, is disposed on said screen.

Thus, maximum efficiency is obtained. The radiation emitted that is not useful is reflected towards the black body where it is again transformed into heat.

BRIEF DESCRIPTION OF THE DRAWINGS

The present invention will be better understood from the following description of the preferred embodiment of the device of the invention, with reference to the accompanying drawings in which.

DESCRIPTION OF THE PREFERRED EMBODIMENT

Figure 1:
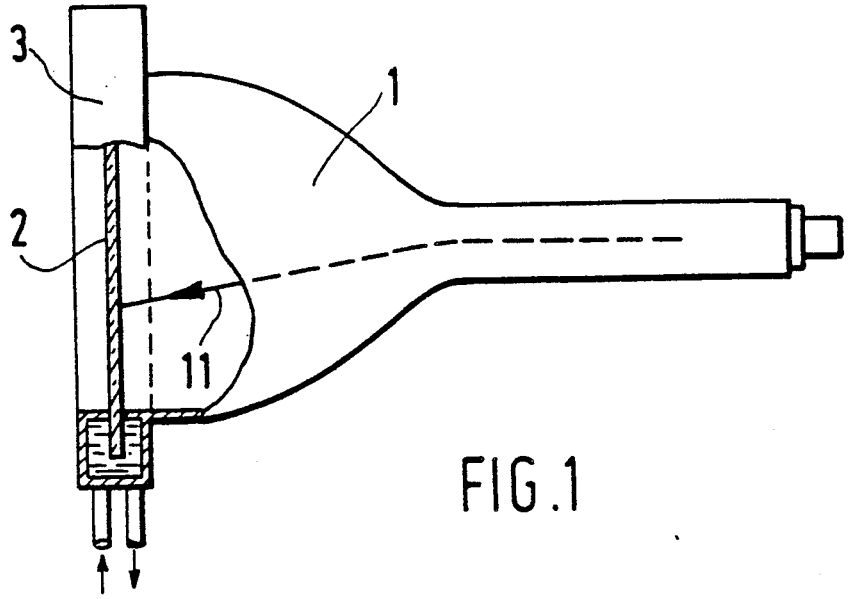
FIG. 1 shows a view in partial section of the device of the invention.

Referring to FIG. 1, a device for generating an infrared image will now be described.

This device comprises a cathode ray tube 1, of known type, having a screen 2 adapted for transforming the energy of the electron beam 11 of tube 1 into infrared radiation.

Thus, from a single video signal of known type, representative of a real or synthetic image and applied to tube 1, an animated infrared image is obtained for testing infrared imagery systems, for example, in the laboratory.

Figure 2:
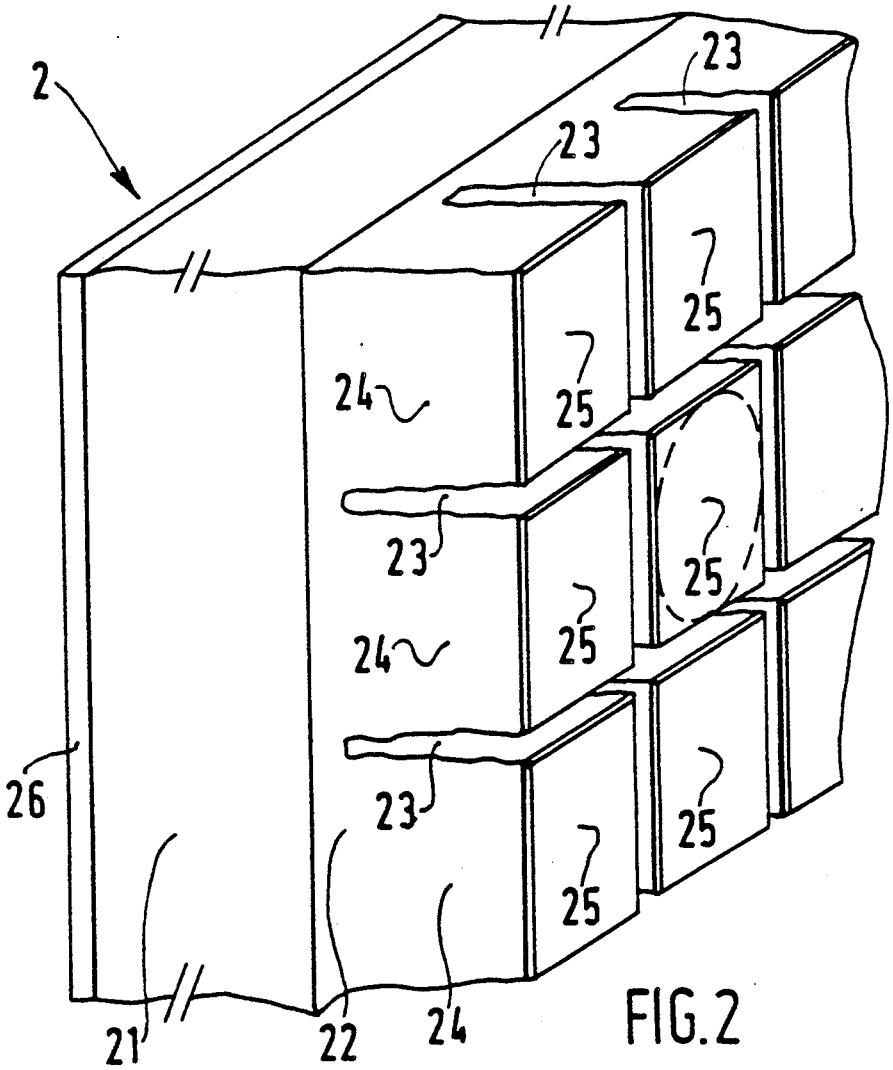
FIG. 2 is a perspective view of a portion of the screen of the device of FIG. 1.

As can be seen in FIG. 2, screen 2 here comprises mainly a plate 21 made from a material which is transparent in the infrared and is heat conducting. The material of plate 21 is for example silicon for the wavelength range between 3 and 5 microns, or germanium for the wavelength range between 8 and 12 microns. The thickness of plate 21 is here from 5 to 10 mm.

On the face of plate 21 disposed inside tube 1 is deposited a layer 22, of a thickness here equal to 50 microns, made from a material transparent in the infrared and heat insulating. Here, the material of layer 22 is arsenic trisulfide $As_2S_3$ or arsenic triselenide $As_2Se_3$, or glass containing chalcogenide $Ge_{33}As_{12}Se_{55}$ or else silver chloride AgCl. The choice of one of these materials is related to the temperature likely to be reached by layer 22. Arsenic trisulfide and triselenide can be used up to 150° C., chalcogenide glass up to 300° C. and silver chloride glass up to 900° C. However, these latter two compounds have a higher heat conductivity.

In layer 22 are formed two series of furrows 23, here of a width of 20 microns and a depth of 200 microns, furrows 23 of a series being all parallel to each other and perpendicular to the furrows 23 of the other series. The furrows 23 of one series are repeated with a spacing here of 250 microns.

Layer 22 is thus reticulated and so comprises a plurality of elementary slabs 24 of 200 x 250 x 250 microns.

Layer 22 is deposited in a way known per se by evaporation, by flowing glass or by bonding, and the furrows 23 are etched mechanically, by means of a diamond, or else by photolithography etching, or else by laser machining. Random reticulation may be obtained by using the heat expansion differences between the screen and the insulating layer. If the latter is higher, during cooling, it will contract more and if its modulus of rupture is lower than its adherence to the screen, it will break up into flakes forming the cross-linking which will thus be obtained naturally, the mean dimension of the flakes being a complex function of the thickness of the rupture modulus of the layer.

On the free face, parallel to plate 21, of each slab 24 is deposited by high temperature evaporation a layer 25 of a material having high emissive power in the infrared, here a black body, for example chromium oxide. The thickness of layer 25 is about a micron. As will be better understood hereafter, each portion of layer 25 is a pixel of the infrared image appearing on the screen 2.

On the face of plate 21 disposed outside tube 1 is deposited a layer 26 of a material, of known type, which is anti-reflective in the wavelength range in which it is desired to use the infrared image.

The periphery of plate 21 is fast with a cooling device, for example a water-flow ring 3.

The cathode ray tube 1 is, for example, except for the screen, of the type sold by the firm RTC under the reference 221 P 14. This tube is provided for scanning a screen of 100 x 75 mm, with a section of beam 11 of about 250 microns in diameter, capable of transporting a current of 2 mA at a voltage of 30 kV. The power of the electron beam 11 is thus 60 W.

The device which has just been described operates as follows.

The electron beam 11 scans the rear face of plate 21 as it would in a conventional tube. It successively and directly bombards the chromium oxide, or black body, of each layer or pixel 25.

The section of beam 11 is here substantially equal to the total area of layer 25 and the latter serves both for converting the energy brought by beam 11 into heat and for converting this heat into infrared radiation. Layer 25 is therefore heated directly by beam 11.

Because of furrows 23 and because of the low heat conductivity of slab 24, the heat thus created remains confined laterally for a time compatible with the scanning of the image by the beam. This prevents a pixel from encroaching on other adjacent pixels. Thus, layer 25 emits infrared radiation related to the power of the beam at the time when it bombarded it, with a remanence time greater than the renewal time, so as to limit "flickering" of the image. As mentioned above, this remanence specification may disappear if the device is used for testing systems employing detector mosaics. Only the synchronization of the lines or of the images need be provided.

The infrared radiation emitted by layer 25 passes through slab 24, plate 21 and layer 26. Thus, this layer 25 is a pixel of the infrared image obtained since it is the one which is at the origin of the radiation observed. The part of the radiation whose wavelength is in the range in which the anti-reflective layer 26 is efficient passes through this layer 26. On the other hand, the remaining portion of the radiation, which does not pass through layer 26, is reflected towards the black body layer 25, in which it is again converted into heat, which correspondingly increases the efficiency of the assembly.

Plate 21 is a good heat conductor and it is cooled by the cooling ring 3 so as to permanently remove the heat from slabs 24. That avoids a progressive rise in temperature of plate 21 which would otherwise finish by lowering the contrast of the image, and introduce streaking of the animated images.

One of the advantages of the invention, apart from its particularly simple structure, is the high temperature which each of the chromium oxide layers 25 is likely to attain.

A simple calculation in fact shows that with a 60 W electron beam, which scans a screen of 100 x 75 mm, the temperature of the layers 25 may theoretically reach 255° C. In practice, this temperature will be a little lower, depending particularly on the heat conductivity and on the thickness of slabs 24 and on the temperature of plate 21. Nevertheless, the device makes it possible to produce images in which the infrared radiation varies with considerable dynamics.

Naturally, it is possible to further increase the intensity of the radiation emitted, i.e. the radiance of the black body, by reducing the size of the area scanned, all other things being equal.

It is obvious that the different numerical values have only been given by way of example during the preceding description, and that it is within the scope of a man skilled in the art to modify them, as required, depending on the characteristics of the tube and beam employed. By way of example, with a beam of given diameter, it is possible to reduce the size of the pixels until their dimension is substantially half the diameter of the beam. In fact, in this case, spatial sampling of the image is achieved which however remains readable as long as Shannon's theorem is respected.

What is claimed is:

1. A device for generating an infrared image comprising:

a screen, transparent in the infrared and supporting a plurality of pixels made from a material having high emissive power in the infrared range, and means for selectively heating the material of each of said pixels;

said heating means comprising an electron beam directly bombarding said high emissive power material, and a section of said electron beam being substantially equal to the area of a pixel.

2. The device as claimed in claim 1, further comprising a reticulated layer of material which is transparent in the infrared and is heat insulating, said reticulated layer being disposed between said screen and said pixels.

3. The device as claimed in claim 2, wherein the material of said reticulated layer is chosen from the following materials: arsenic trisulfide $As_2S_3$, arsenic triselenide $As_2Se_3$, glass containing chalcogenide $Ge_{3.3}As_{12}Se_{55}$ and silver chloride AgCl.

4. The device as claimed in claim 1, wherein said screen is heat conducting and means are provided for cooling said screen.

5. The device as claimed in claim 1, wherein a layer, which is anti-reflective in the wavelength range of use of the infrared image, is deposited on said screen.

6. A device for generating an infrared image comprising:

a screen which is transparent in the infrared range;

a plurality of pixels, supported on said screen, each pixel comprising a material having high emissive power in the infrared range, and each pixel having a predetermined area; and an electron beam heating the material of each of said pixels by directly bombarding said high emissive power material, wherein the section of said electron beam is substantially equal to the predetermined area of each pixel.

* * * * *